US011242702B2

(12) United States Patent
Qiu

(10) Patent No.: US 11,242,702 B2
(45) Date of Patent: Feb. 8, 2022

(54) PUSH-PULL PASSAGE LOCK

(71) Applicant: CMECH (GUANGZHOU) LTD., Guangzhou (CN)

(72) Inventor: Jia Sen Qiu, Guangzhou (CN)

(73) Assignee: CMECH (GUANGZHOU) LTD., Guangdong (CN)

( * ) Notice: Subject to any disclaimer, the term of this patent is extended or adjusted under 35 U.S.C. 154(b) by 1117 days.

(21) Appl. No.: 15/796,550

(22) Filed: Oct. 27, 2017

(65) Prior Publication Data

US 2018/0363340 A1 Dec. 20, 2018

(30) Foreign Application Priority Data

Jun. 19, 2017 (CN) ..... 201710462506.8

(51) Int. Cl.

| | |
|---|---|
| ***E05B 15/00*** | (2006.01) |
| ***E05B 15/02*** | (2006.01) |
| ***E05B 63/00*** | (2006.01) |
| ***E05C 1/14*** | (2006.01) |
| ***E05B 9/02*** | (2006.01) |

(52) U.S. Cl.

CPC ..... *E05C 1/14* (2013.01); *E05B 9/02* (2013.01); *E05B 15/0033* (2013.01); *E05B 15/02* (2013.01); *E05B 63/0056* (2013.01)

(58) Field of Classification Search

CPC ..... E05C 1/14; E05B 15/0033; E05B 9/02; E05B 63/0056; E05B 15/02; E05B 63/006; E05B 9/08; E05B 3/00; E05B 15/00

USPC .... 292/336.3, 137, 138, 163, 164, 165, 169, 292/175, 140

See application file for complete search history.

(56) References Cited

U.S. PATENT DOCUMENTS 4,629,228 A * 12/1986 Marko ..... E05B 7/00 292/165
4,986,583 A * 1/1991 Campbell ..... E05B 65/104 292/165
10,844,628 B2 * 11/2020 Qiu ..... E05B 15/0033

* cited by examiner

*Primary Examiner* — Christine M Mills
*Assistant Examiner* — Thomas L Neubauer
(74) *Attorney, Agent, or Firm* — McKee, Voorhees & Sease, PLC

(57) ABSTRACT

A push-pull passage door lock comprising at least one handle, at least one lever, at least one rotating block, a slipping block, a latch bolt and a reset device for resetting the latch bolt. The lever, rotating block and slipping block are located inside the housing. The lever and rotating block are hinged to the housing. The rotating block comprises a rotation portion and a touch portion located at the two sides of an articulated shaft of the rotating block. One end of the lever is connected to the handle and the other end is adjacent the rotation portion. One end of the slipping block is connected to the latch bolt and the other end is adjacent the touch portion. The lever rotates the rotation portion of the rotating block, whereby the touch portion of the rotating block pushes up the slipping block and thereby retracts the latch bolt.

24 Claims, 15 Drawing Sheets

PUSH-PULL PASSAGE LOCK

CROSS-REFERENCE TO RELATED APPLICATIONS

This application claims priority to Chinese Patent Application No. 201710462506.8, filed Jun. 19, 2017, which is herein incorporated by reference in its entirety.

FIELD OF THE INVENTION

This invention relates to a push-pull passage lock having a simplified assembly.

BACKGROUND OF THE INVENTION

In the prior art, there are many kinds of door locks, among which a push-pull passage lock is common and widely used. The push-pull passage lock has various structures, and generally comprises a latch bolt or plunger, a sliding frame connected to the latch bolt, and a cam configured inside the sliding frame, wherein the cam rotates and drives the sliding frame to rotate, such that the latch bolt connected to the sliding frame is driven to retract. A reset spring is arranged to reset the sliding frame. This structure is complicated and has many components, thus it is difficult to assemble. In addition, the failure of the reset spring is likely to occur after a long-term service, and then the latch bolt cannot be inserted into the corresponding hole in the door frame any longer.

SUMMARY OF THE INVENTION

The present invention intends to provide a push-pull passage lock, which has a simple structure and fewer components.

The present invention provides a technical solution as follows.

A push-pull passage lock comprises a housing, a pair of handles, a pair of levers, one of which is associated with each handle, a pair of rotation blocks, each being actuable by both of the levers, a slipping block movable by both of the rotating blocks, a latch plunger or bolt, and a reset device for resetting the latch bolt. The levers, the rotating blocks, and the slipping block are located inside the housing. The levers and the rotating blocks are both hinged to the housing. The levers and the rotating blocks are both hinged to the housing. The rotating blocks each comprise a rotation portion and a touch portion which are respectively located at opposite sides of an articulated shaft of the rotating blocks. One end of each lever is connected to one of the handles and the other end is adjacent to the rotation portion of the rotating blocks. One end of the slipping block is connected to the latch bolt and the other end is adjacent to the touch portion of the rotating blocks. Thus, each lever rotates and drives the rotation portion of either rotating block to rotate, whereby the touch portion of the rotating block contacts the slipping block and pushes it upwardly.

Each of the levers is hinged to the housing via a first articulated shaft and each of the rotating blocks is hinged to the hosing via a second articulated shaft, wherein the first articulated shaft is perpendicular to the second articulated shaft.

Two mounting blocks are configured in the housing at intervals, and both mounting blocks are provided with a mounting slot for installing the second articulated shaft.

There is an activity space between the two mounting blocks to allow rotation of the touch portion.

The slipping block includes a protrusion part or finger located within a rotation radius of the touch portion.

The two rotating blocks are located at the opposite sides of one end of the levers, and the slipping block comprises two protruding fingers corresponding to the two rotating blocks, respectively.

The reset device is in a form of a compressed spring which is arranged on an end of the slipping block opposite the fingers.

A cap is configured at the top of the slipping block, and the compressed spring is sleeved on the cap.

A torsional spring for resetting the lever is arranged on the pivot shaft of each lever.

Two handles and two levers are provided, one handle and one lever are located on one side of the slipping block, and the other handle and the other lever are located on the other side of the slipping block.

A pair of mounting plates are also configured around the housing and are located at the two sides of an annular protuberance which is formed on the housing, along its radial direction. The mounting plates and the annular protuberance are connected by bolts around which an adjusting ring or collar is configured, and the adjusting ring is located between the annular protuberance and the mounting plates.

The housing comprises a first housing and a second housing which are connected together wherein the connecting surface of the first housing and the second housing is parallel with the rotation direction of the levers.

The present invention achieves the following technical effects.

(1) For the push-pull passage lock of the present invention, each lever rotates to drive one of the rotating blocks to rotate, which further drives the slipping block to move, whereby the latch bolt is retracted. The push-pull passage lock has a simple structure with fewer components than conventional push-pull locks;

(2) There are two rotating blocks which are configured at the sides of the lever, thus a door can be opened no matter which lever is pushed or pulled.

(3) A lever and a handle are configured at each side of the two sides of the slipping block, thus a door can be opened from both its interior and exterior sides;

(4) When a door has a big thickness, adjusting rings can be placed around the bolts which connect the mounting plates with the annular protuberance to adjust the distance between the two mounting plates, so as to adapt the thickness of a door. When a door has a small thickness, the adjusting rings can be taken off the heights of the adjusting ring can be changed so as to adapt the thickness of the door; and (5) The connecting surface of the first housing and the second housing is parallel with the rotation direction of the lever, which facilitates the assembly and disassembly.

DETAILED DESCRIPTION OF THE PREFERRED EMBODIMENTS

Figure 1:
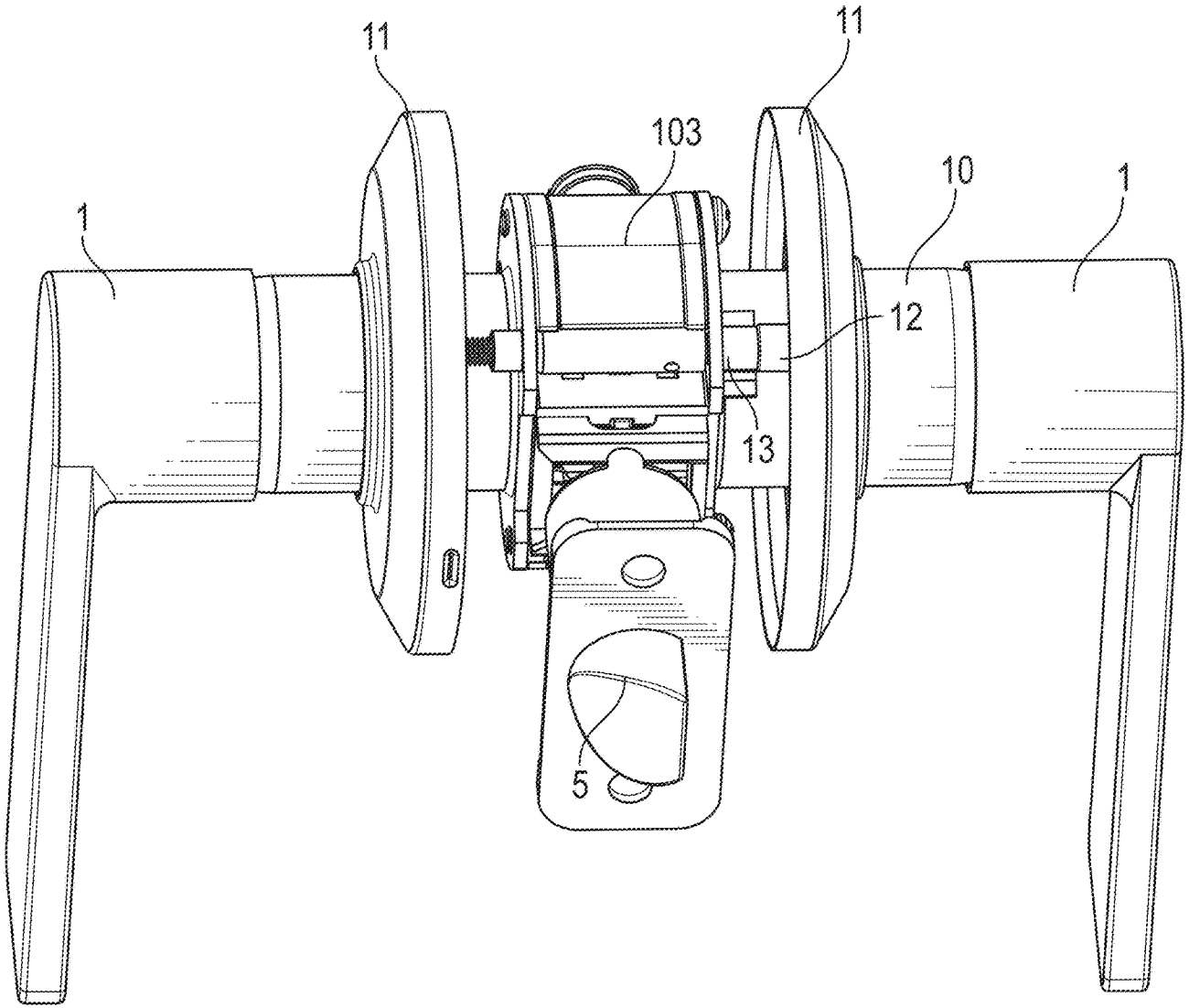
FIG. 1 is a perspective view of a push-pull passage lock of the invention in a neutral or rest position when neither handle is pushed or pulled.
Figure 2:
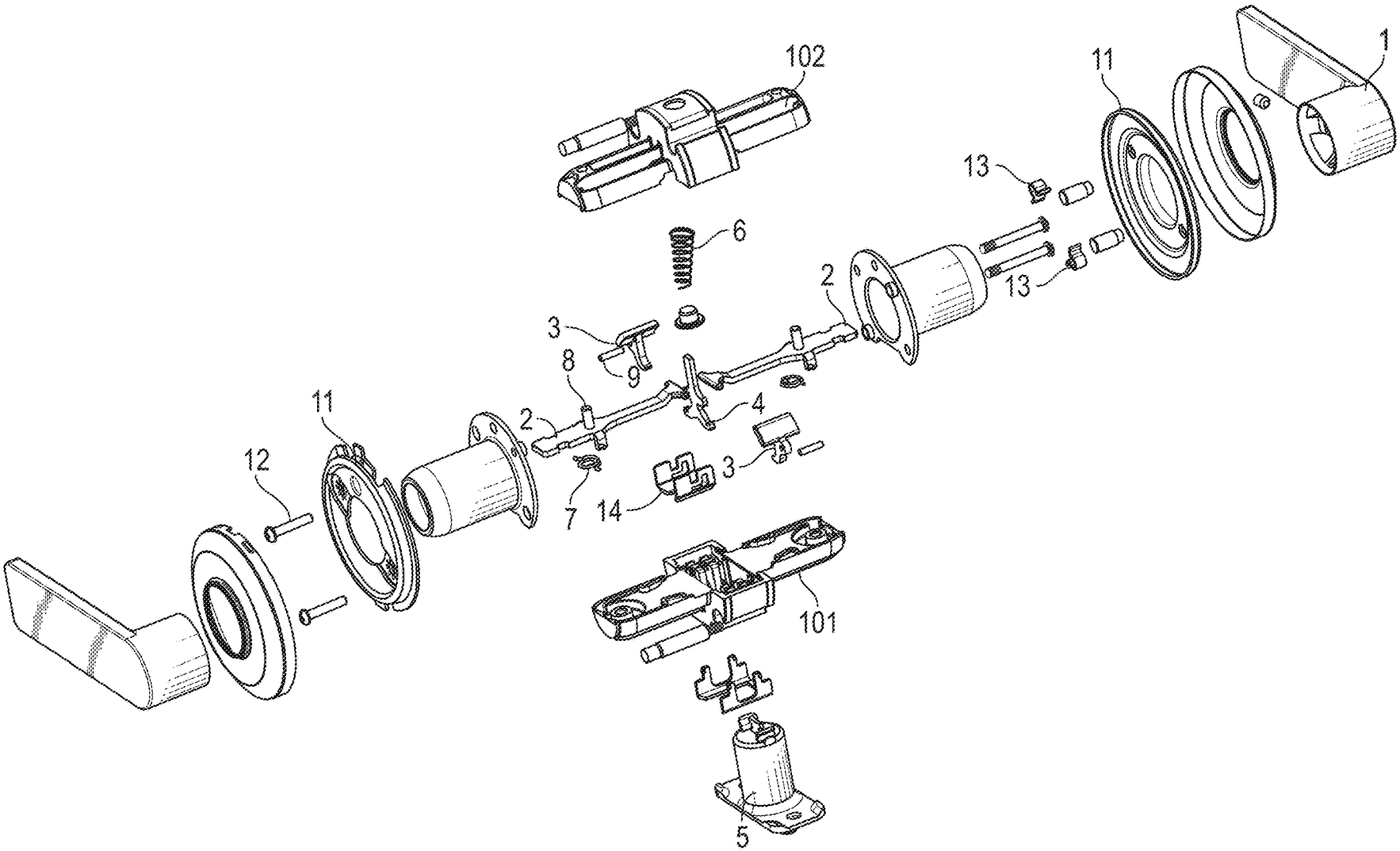
FIG. 2 is an exploded view of the push-pull passage lock of the invention.
Figure 3:
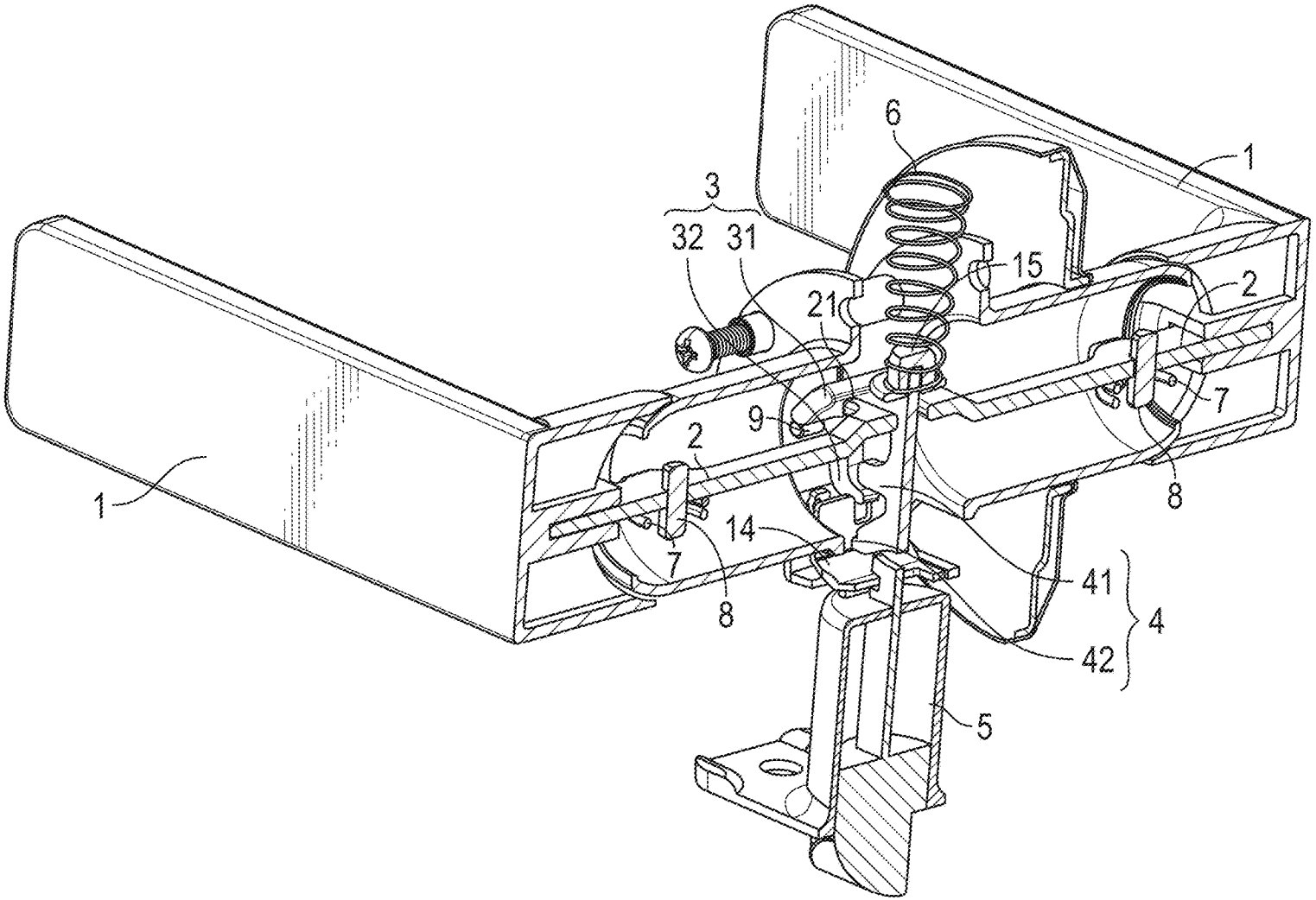
FIG. 3 is a sectional view of a push-pull passage lock of the invention at rest, and the upper and lower housings removed for clarity.

As shown in the Figures, the invention provides a push-pull passage lock comprising interior and exterior door handles 1, levers 2 each associated with one of the handles 1, rotating blocks 3 rotatable by pivotal action of the levers 2, a slipping block 4 actuable by rotation of the blocks 3, a latch bolt or plunger 5 retractable by the slipping block 4, and a reset device 6 for resetting the latch bolt 5. The levers 2, the rotating blocks 3 and the slipping block 4 are located inside a housing 10. The levers 2 and the rotating blocks 3 are both pivotally connected to the housing 10.

Each rotating block 3 comprises a rotation portion 31 engageable by the levers 2 and a touch portion 32 engageable with the slipping block 4. The portions 31 and 32 are respectively located at the two sides of a pivot shaft 9 of the rotating block 3. One end of the lever 2 is connected to the handle 1 and the other end is adjacent to the rotation portion 31. One end of the slipping block 4 is connected to the latch bolt 5 and the other end is adjacent to the touch portion 32. Thus, the lever 2 rotates and drives the rotation portion 31 to rotate, and then the touch portion 32 is driven to rotate and push the slipping block 4 upwardly. The lever 2 rotates to drive the rotation portion 31 of the rotating block 3 to rotate, then the touch portion 32 is driven to rotate, which further drives the slipping block 4 to move, and thereby the latch bolt 5 is retracted to allow the door to be opened.

This push-pull passage lock has fewer parts and has a simplified structure compared to prior art push-pull door handles.

As shown in FIGS. 3, 5, 6 and 8, each lever 2 is pivotally connected to the housing 10 via a first articulating shaft or pin 8, with a torsional spring 7 sleeved on the pivot shaft 8 to reset the lever 2 to a neutral or rest position when the handle 1 is not pushed pulled. One end of the torsional spring 7 is connected to the lever 2 and the other end is connected to the housing 10. One end of the lever 2 is located on one side of the shaft or pin 8 and is connected to the handle 1 via a set screw 23 (FIG. 8) threaded into the handle 1 and extending into a notch 22 in the lever 2, while the other end of the lever 2 is located on the other side of the first shaft or pin 8 and is provided with oppositely extending toggle parts 21, which may be in a form of protrusions or fingers extending laterally on the lever 2.

Figure 4:
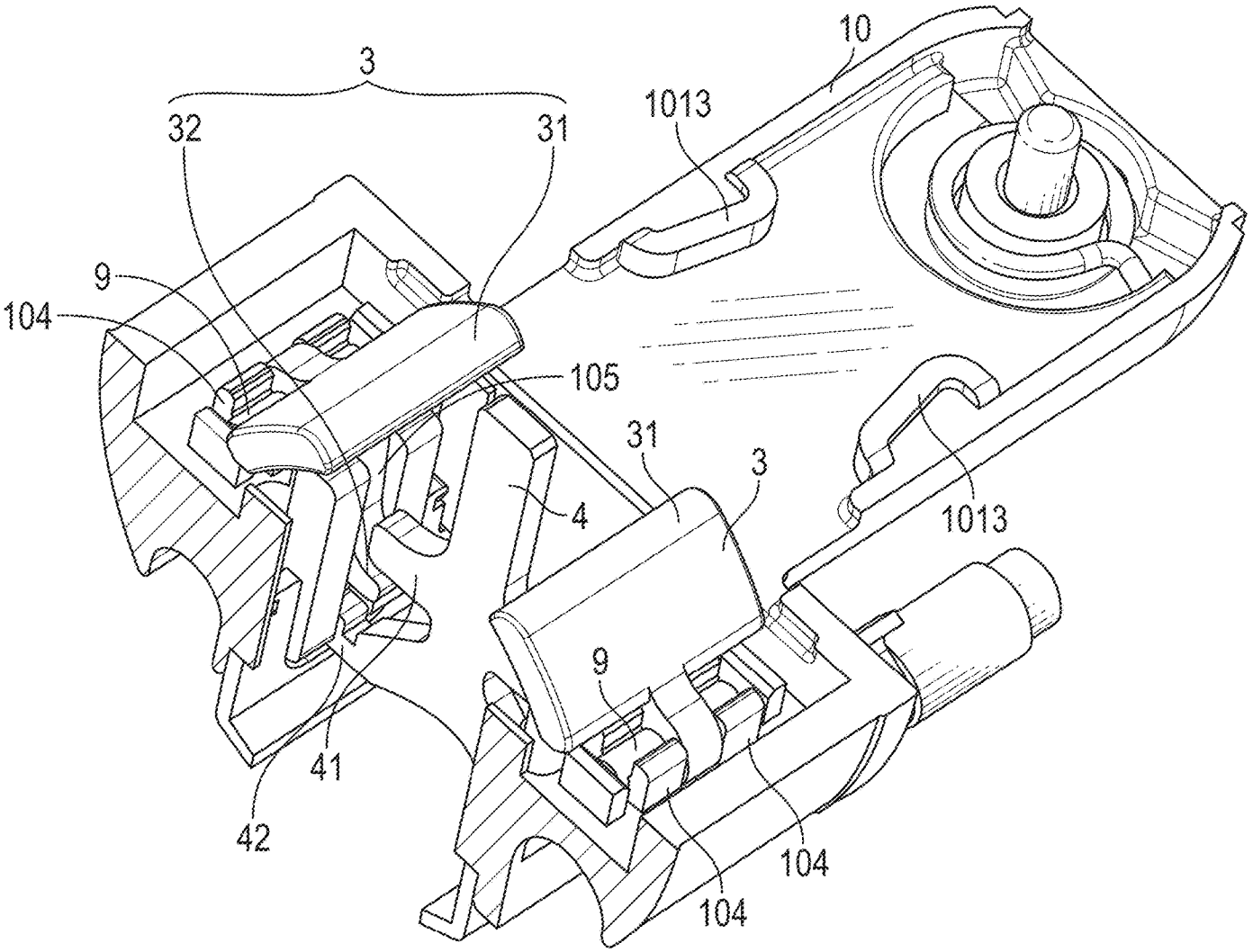
FIG. 4 is a partial sectional view of a portion of the push-pull passage lock of the invention, with the lever removed for clarity.

Each rotating block 3 is pivotally mounted in the housing 10 via a second articulating shaft or pin 9, which is perpendicular to the first shaft 8. The rotating block 3 comprises a rotation portion 31 and a touch portion 32 which are respectively located on the two sides of the shaft 9 of the rotating block 3. Specifically, as shown in FIG. 4, for each rotating block 3, two mounting blocks 104 are configured in the housing 10 at spaced apart intervals, and each mounting block 104 is provided with a slot for receipt of the second shaft 9. An activity space 105 is provided between the two mounting blocks 104 to allow the touch portion 32 to rotate. The rotation portion 31 is located upon the mounting block and has a longer length along the second articulated shaft 9 which ensures contact with the toggle part 21 of the lever 2. The touch portion 32 has a shorter length along the second articulated shaft 9, and is located inside the activity space 105, forming a compact structure. In the preferred embodiment, the rotation portion 31 of the rotating block 3 and the toggle part 21 engaged at a sharp or acute angle. The toggle part 21 is adjacent to the rotation portion 31, and drives the rotation portion 31 to rotate when the lever 2 rotates, whereby the whole rotating block 3 is driven to rotate about the pin 9.

The slipping block 4 comprises a vertical body, a pair of laterals extending upper fingers or protrusion parts 41 protruding from the body and a pair of laterally extending lower hooks 42 located at the end of the body. The protrusion part 41 is located within a rotation radius of the touch portion 32, thereby the protrusion part 41 will be driven to rotate when the touch portion 32 rotates, and the hook 42 is connected to the latch bolt or plunger 5 via a connector 14. Specifically, the hook 42 and the connector 14 are hooked together, and the connector 14 and the latch bolt 5 are also hooked together. Thus, the protrusion part 41 of the slipping block 4 can be driven to move by the rotation of the touch portion 32, which drives the whole slipping block 4 can be driven to move by the rotation of the touch portion 32, which drives the whole slipping block 4 to move, and thus drives the connector 14 hooked to the slipping block 4 to move, whereby the latch bolt 5 hooked to the connector 14 is driven to be retracted.

In the preferred embodiment, two handles 1 and 2 levers 2 are provided, wherein one handle 1 and one lever 2 are located on one side of the slipping block 4, and the other handle 1 and the other lever 2 are located on the other side of the slipping block 4. There are two rotating blocks 3 which are configured at the two sides of the lever 2, and the slipping block 4 comprises two protrusion parts 41 which are corresponding to the two rotating blocks 3 respectively. Thus, the latch bolt 5 is driven to retract by actuation of either of the handles land either of the levers 2. Thus, the two handles 1 are located at the two sides of a door respectively, and the door can be opened by pushing or pulling either of the handles on the inside or outside the room.

Figure 5:
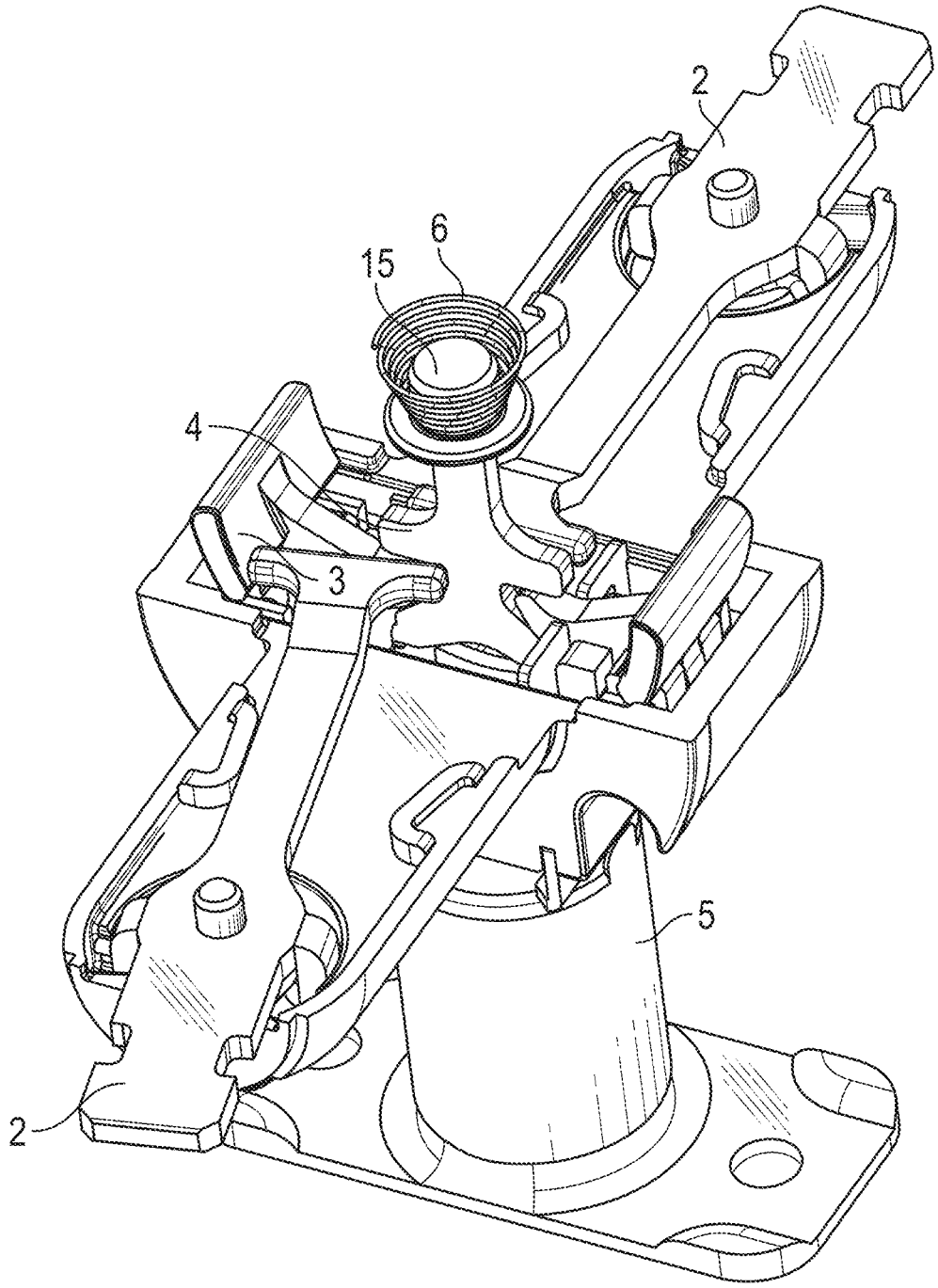
FIG. 5 is a partial perspective view of the push-pull passage lock of the invention with one of the levers actuated.
Figure 6:
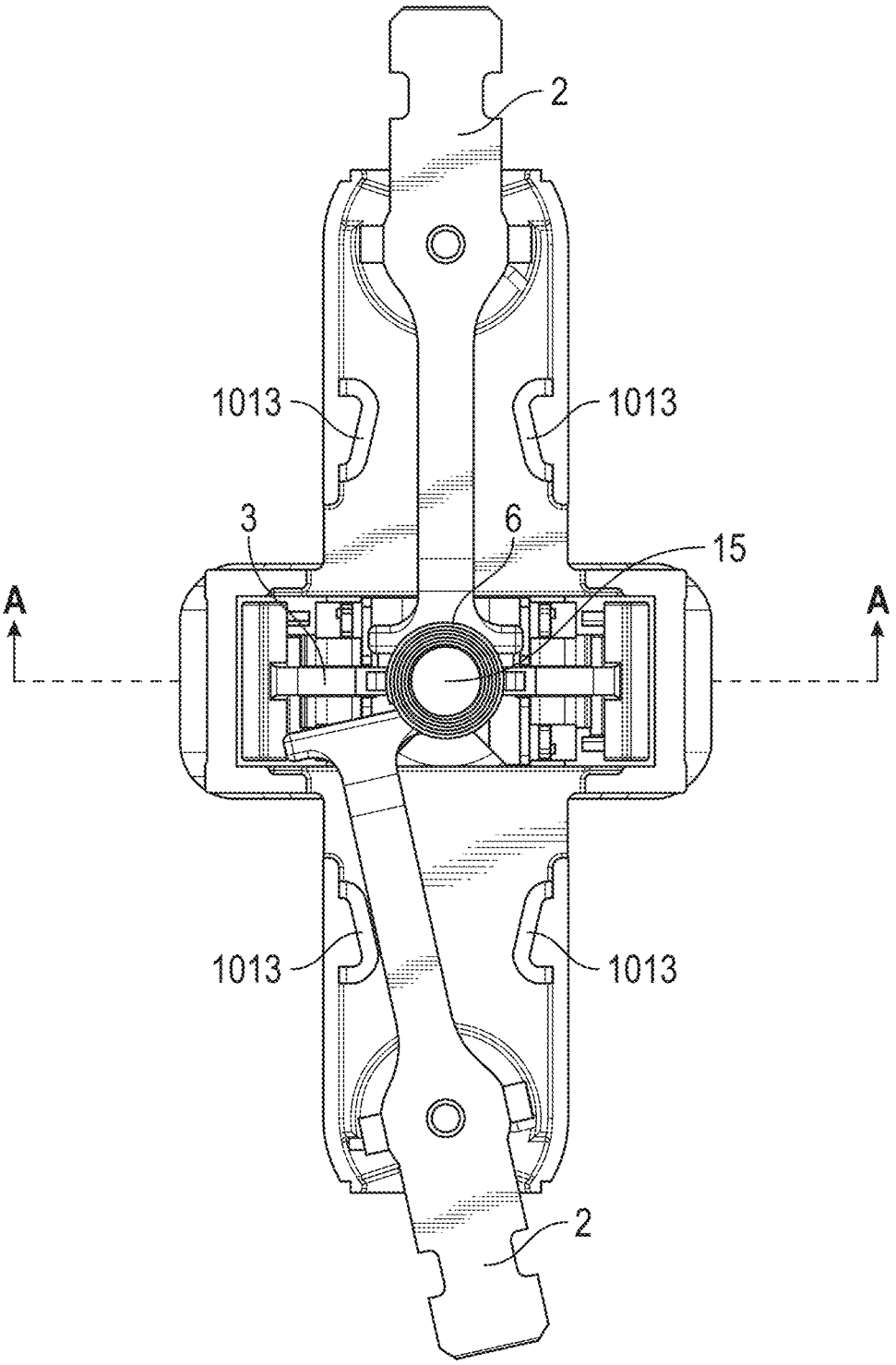
FIG. 6 is a top view of FIG. 5.
Figure 7:
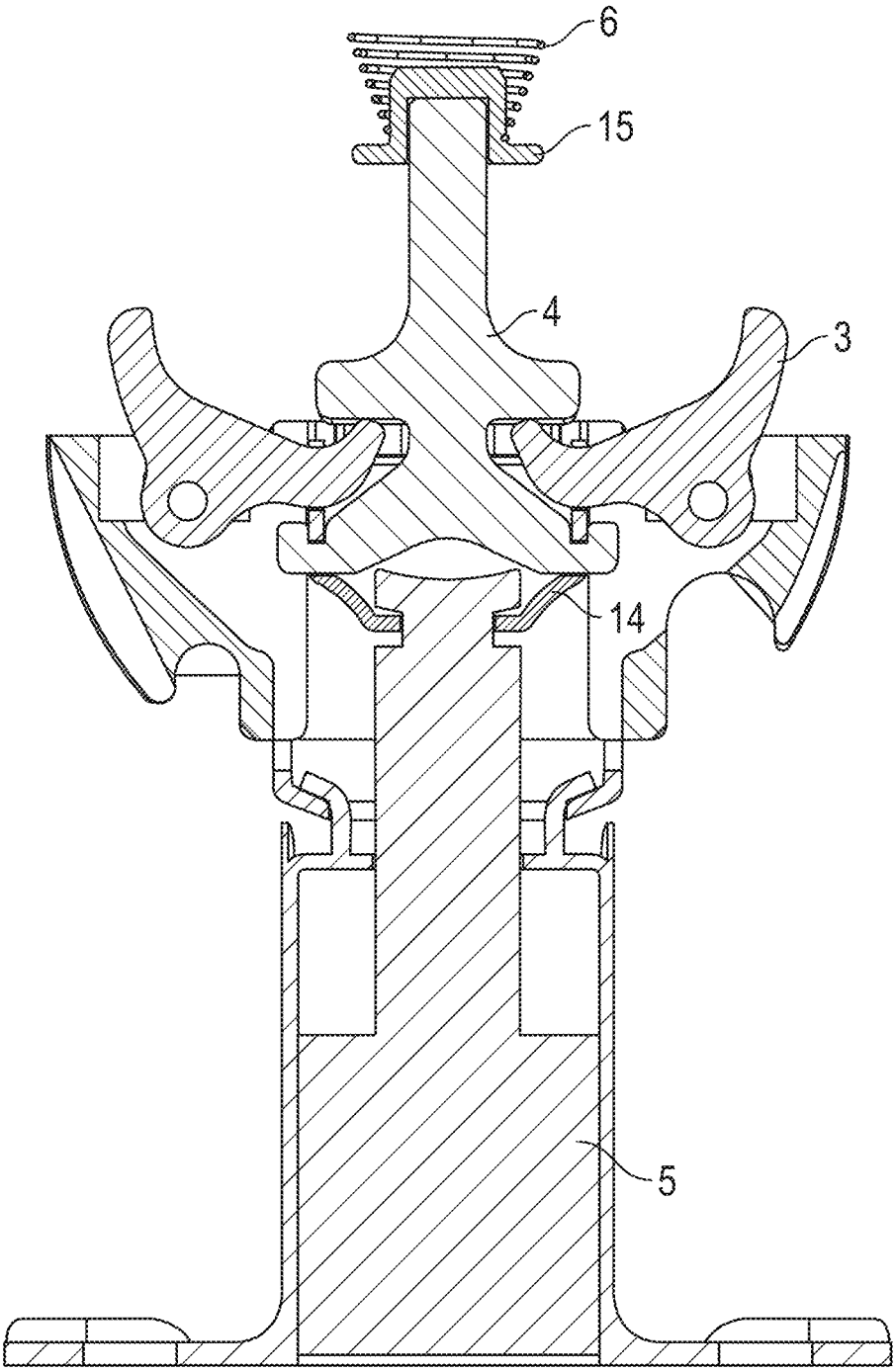
FIG. 7 is an enlarged sectional view along A-A line of FIG. 6.

As shown in FIGS. 5 to 7, the reset device is in a form of a compressed spring 6 and a cap 15 positioned on the top of the slipping block 4. An installation shaft or cylindrical body is configured at the top of the cap 15, and the compressed spring is sleeved on the installation shaft to reset or extend the retracted latch bolt 5 after the handle 1 is released.

Figure 8:
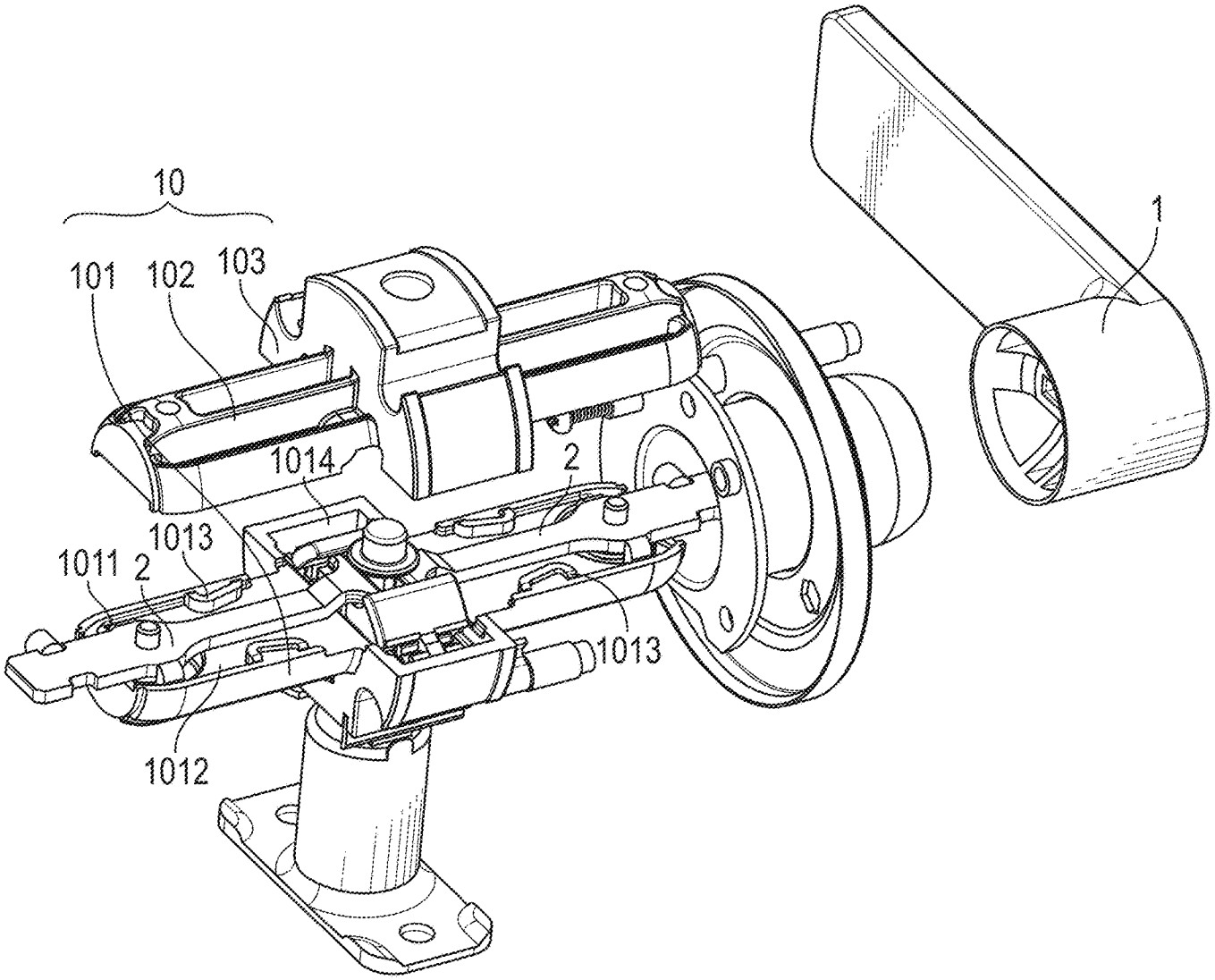
FIG. 8 is another exploded view of a portion of the push-pull passage lock of the invention.
Figure 9:
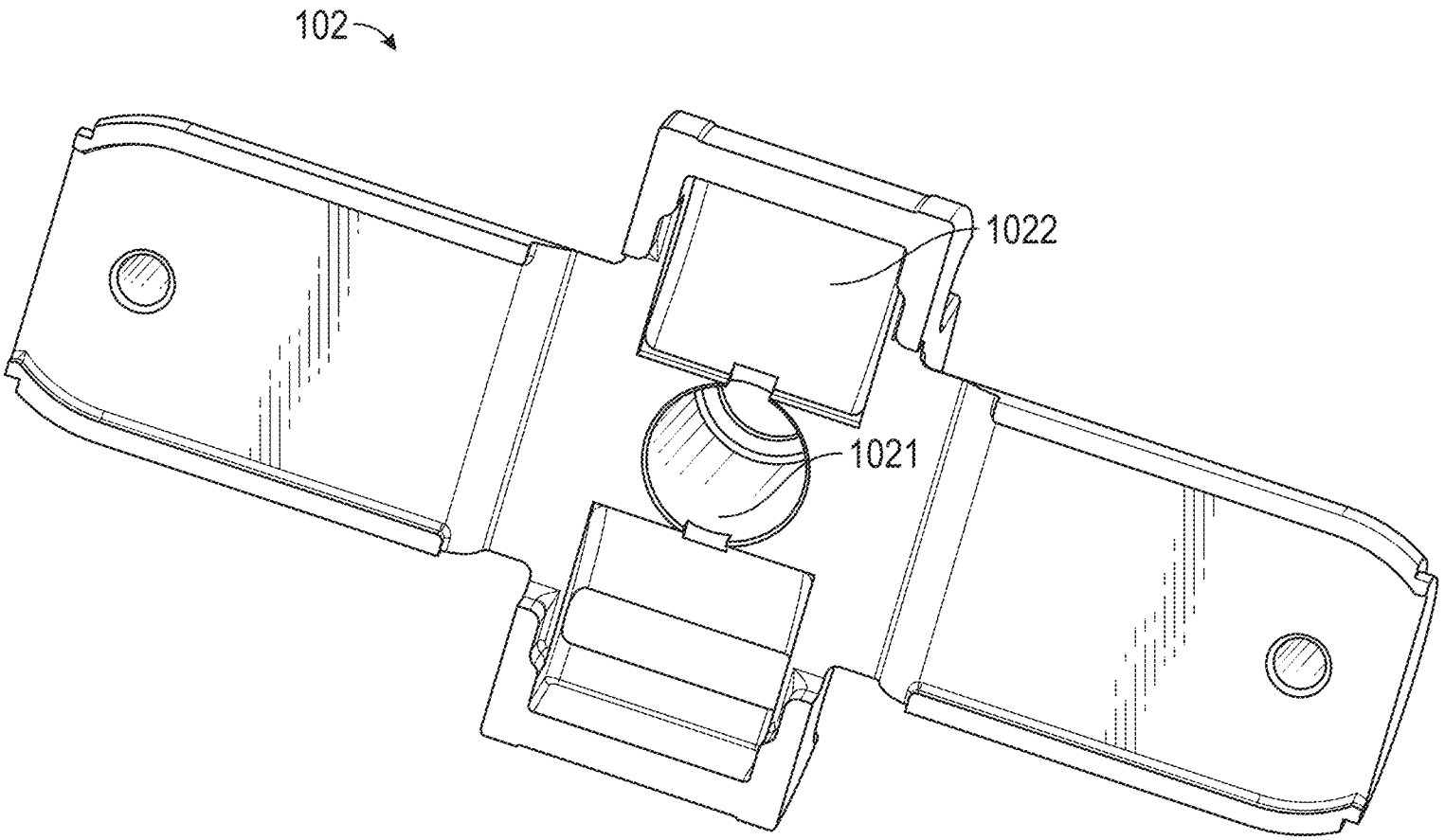
FIG. 9 is a perspective view of the upper housing of the push-pull passage lock of the invention.
Figure 10:
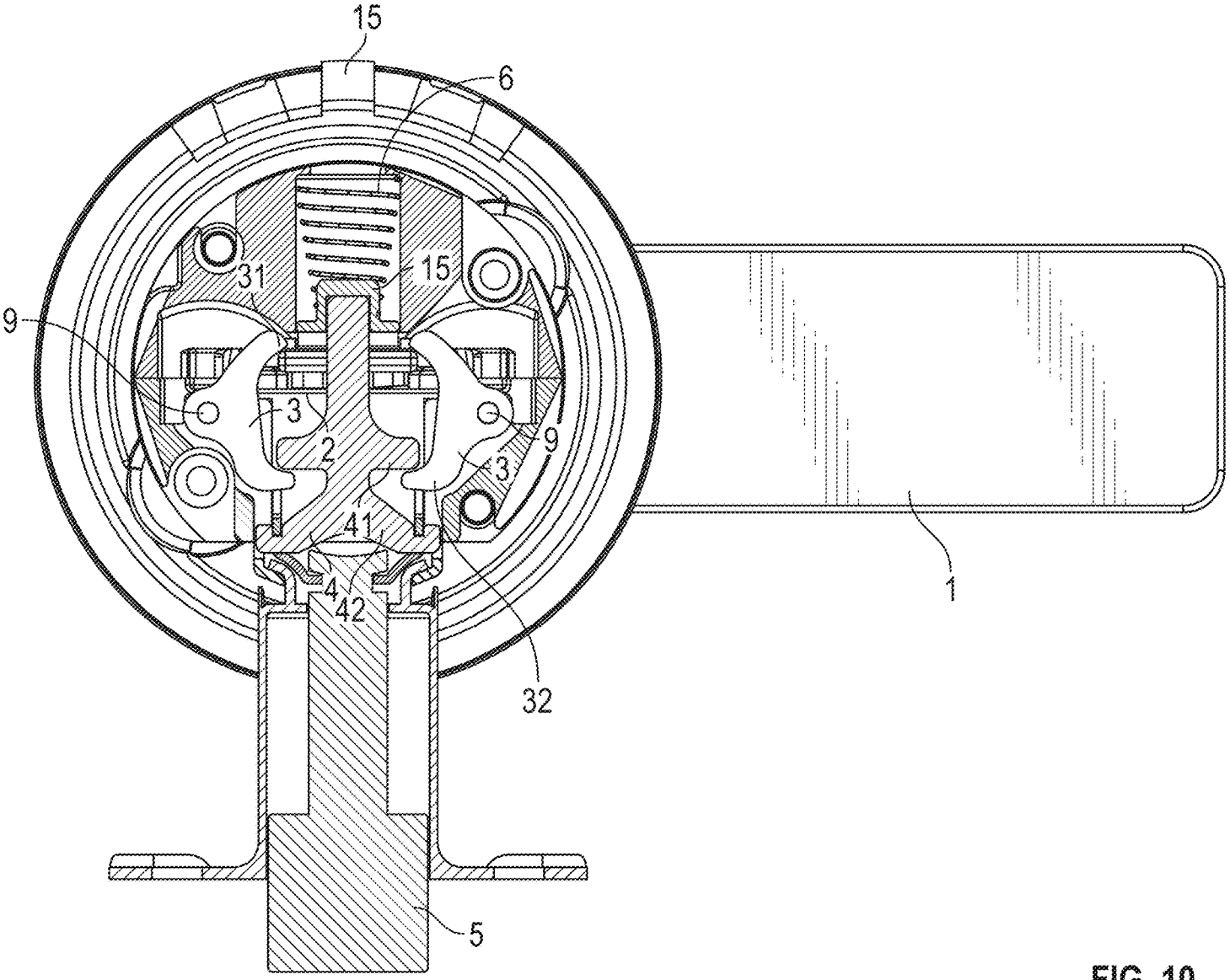
FIG. 10 is sectional view perpendicular to the section of FIG. 3, with the push-pull passage lock at rest.
Figure 11:
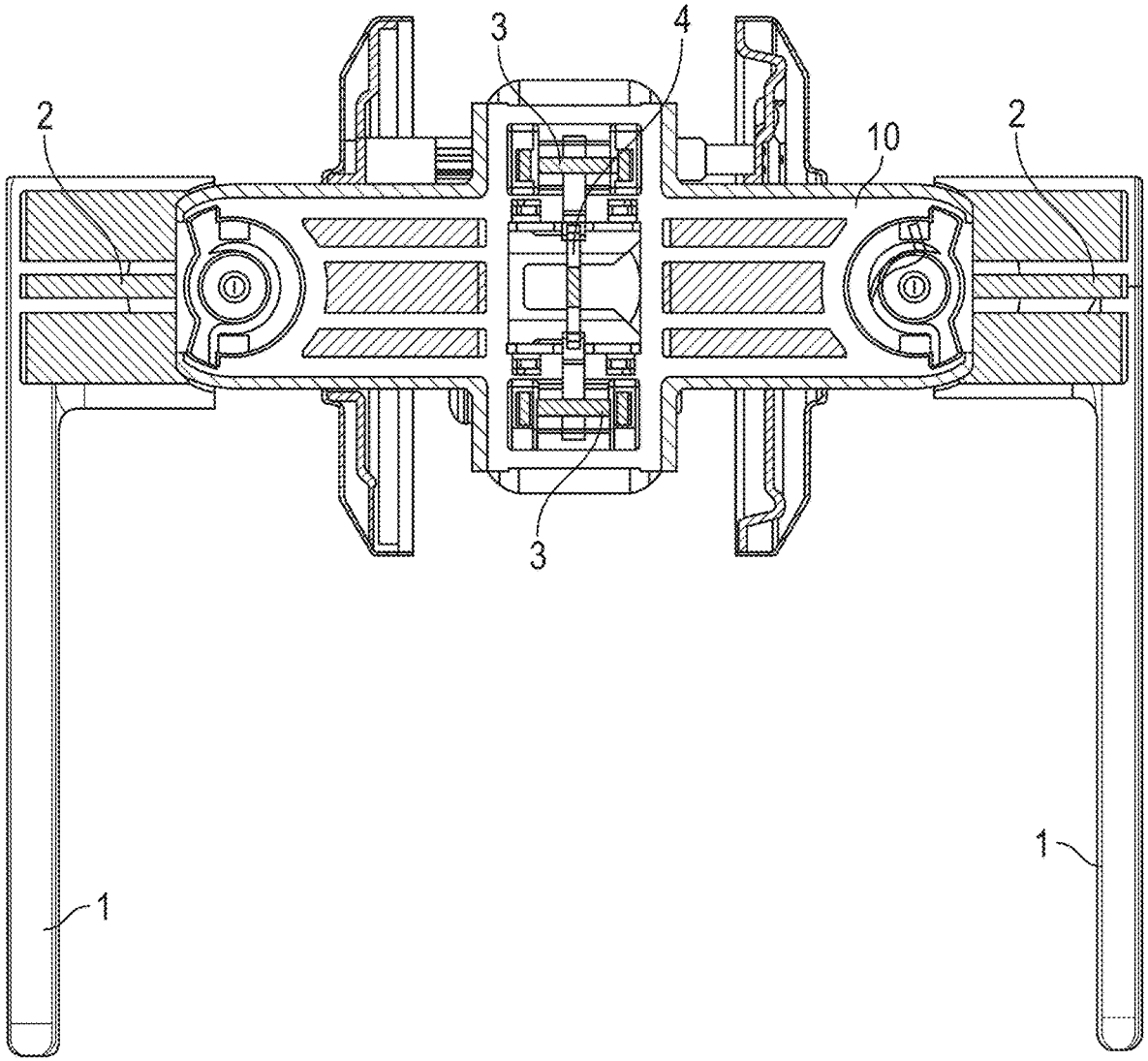
FIG. 11 is a sectional view along the longitudinal axis of the push-pull passage lock at rest.
Figure 12:
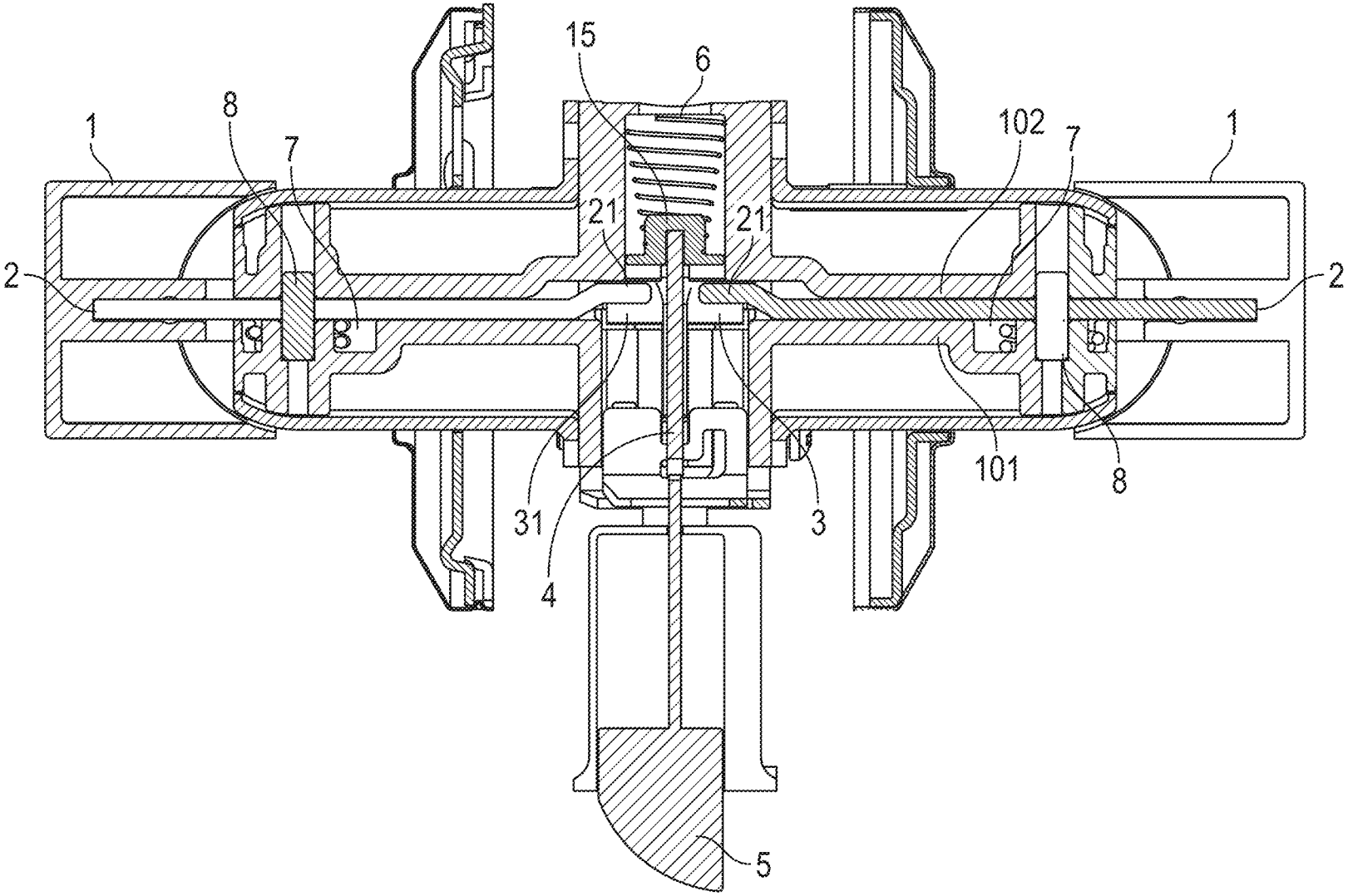
FIG. 12 is another sectional view along the longitudinal axis of the push-pull passage lock, at rest, according to the present invention.
Figure 13:
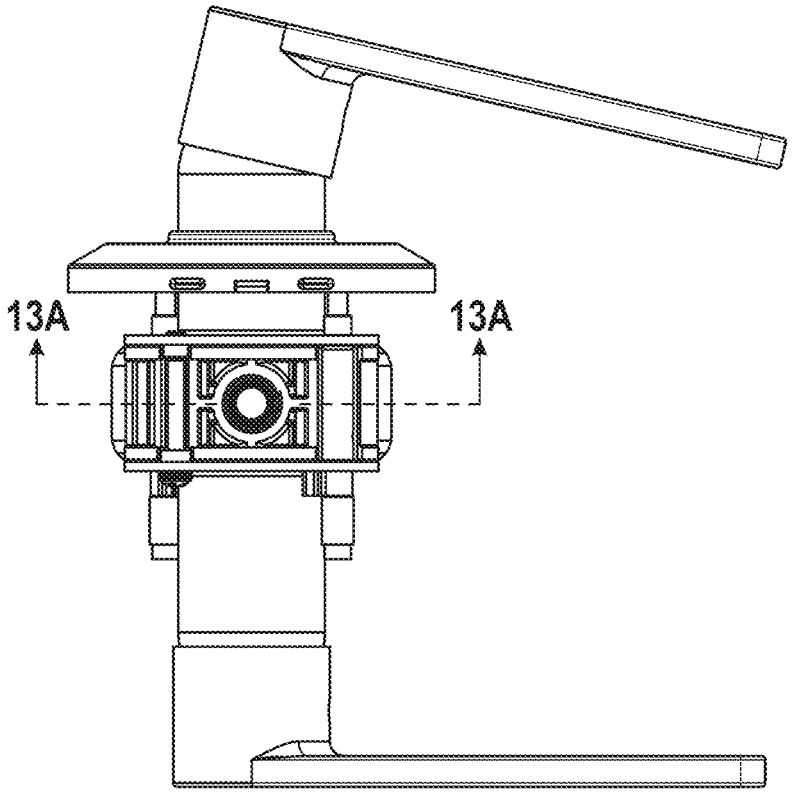
FIG. 13 is a view of the push pull passage lock handle assembly of the present invention, with one handle pushed to retract the plunger (and with one of the mounting plates 11 removed for clarity).
Figure 13A:
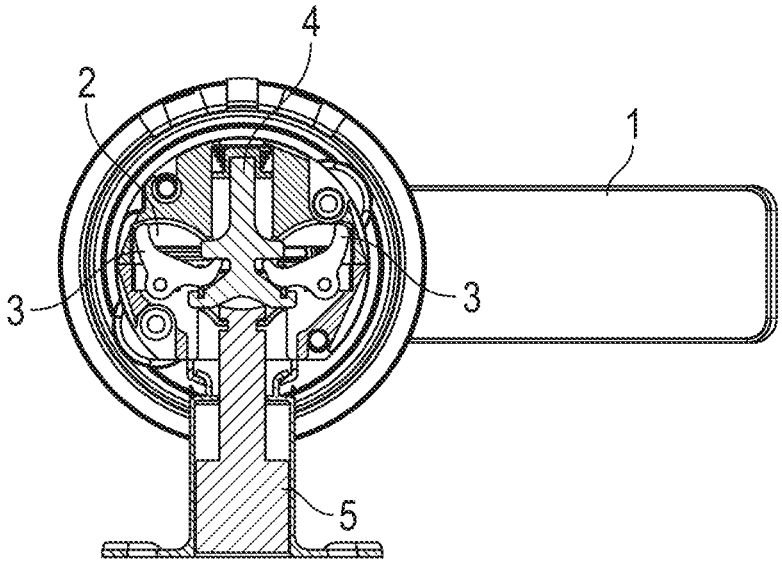
FIG. 13A is a sectional view taken along lines A-A of FIG. 13.
Figure 14:
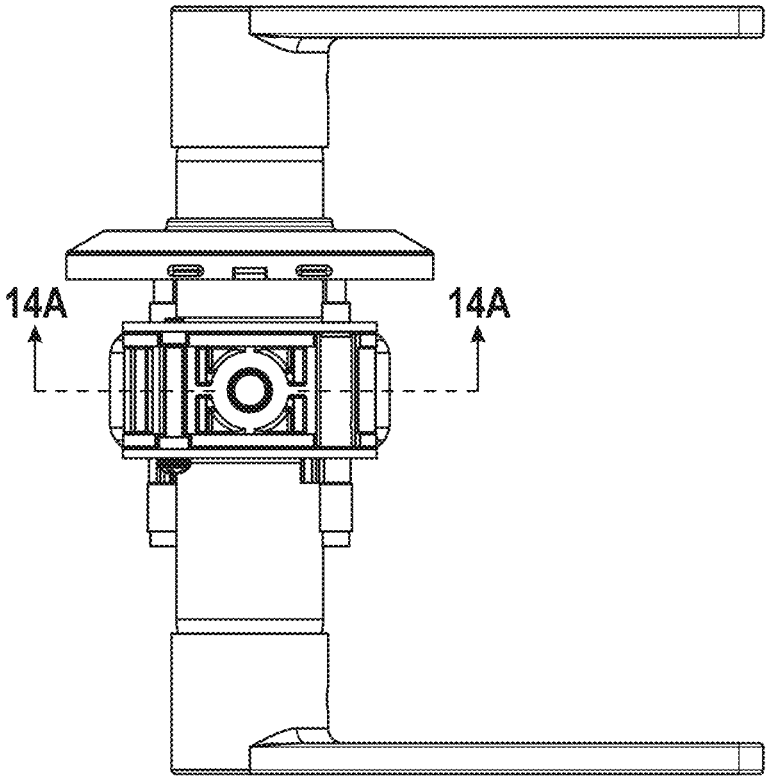
FIG. 14 is a view similar to FIG. 13, with the handles in a neutral or free position, wherein the plunger is in an extended position.
Figure 14A:
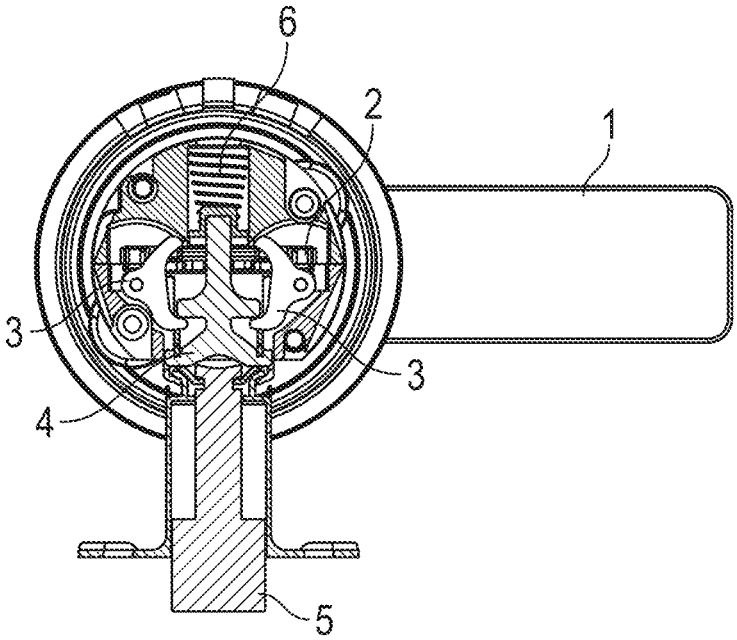
FIG. 14A is a sectional view taken along lines A-A of FIG. 14.
Figure 15:
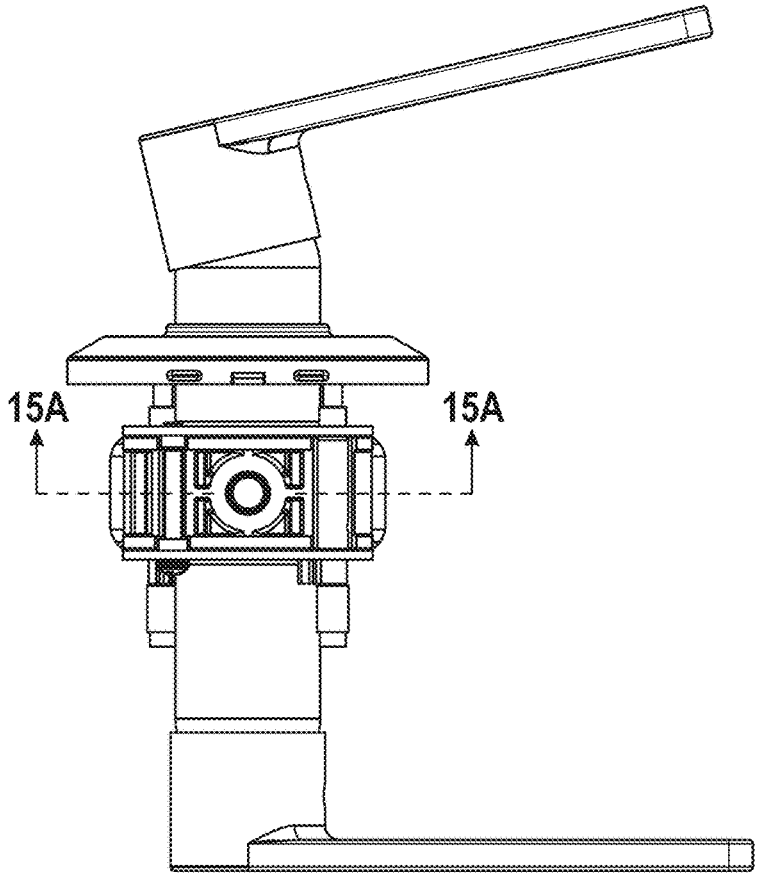
FIG. 15 is a view similar to FIG. 13, with one of the handles pulled to retract a plunger.
Figure 15A:
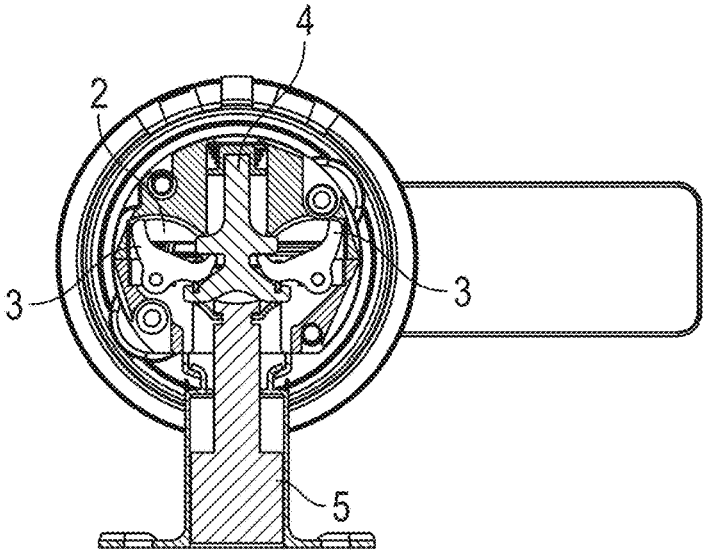
FIG. 15A is a sectional view taken along lines A-A of FIG. 15.

As shown in FIGS. 8 and 9, the housing 10 comprises a first housing 101 and a second housing 102 which are connected together, wherein the connecting surfaces of the first housing 101 and the second housing 102 are parallel with the rotation direction of the levers 2, which facilitates the installation or assembly. The first housing 101 has a mounting groove 1011 for installing the torsional spring 7 and an activity chamber 1012 in which the lever 2 rotates. The activity chamber 1012 comprises two sidewalls which are situated respectively at opposite sides of the lever 2, thereby preventing a failure of the compressed spring 6 due to any super compression. A first receiving chamber 1014 is configured in the first and second housings 101, 102 for receiving the rotating block 3 and the slipping block 4. A second receiving chamber 1021 (FIG. 9) for installing the resetting spring 6 is formed in the second housing 102. A third receiving chamber 1022 for holding the rotating block 3 is configured on opposite sides of the second receiving chamber 1021.

As shown in FIG. 1, the housing 10 is cylindrical as a whole, and protrudes along its radial direction in the middle part of the housing 10 to form an annular protuberance 103. Two mounting plates 11 located at the two sides of the annular protuberance 103 are arranged around the housing 10. The mounting plates 11 and the annular protuberance 103 are connected by bolts 12 having threaded ends. An adjusting ring or insert 13 is configured around the threaded end for adjusting the distance between the mounting plate 11 and the annular protuberance 103. The bolts 12 pass through the annular protuberance 103, the adjusting ring or insert 13 and mounting cover plates 11, and are in threaded connection with nuts. When a door has a big thickness, the inserts 13 can be place around the bolts 12 which connect the mounting plates with the annular protuberance, to adjust the distance between the two mounting plates so as to adapt the thickness of a door. When a door has a small thickness, the inserts 13 can be taken off or the heights of the inserts can be changed so as to adapt the thickness of the door. The push-pull door handle lock assembly of the present invention is further described in concurrently filed application Ser. No. 15/796,352, entitled PUSH-PULL PASSAGE LOCK HOUSING and Ser. No. 15/796,102, entitled PUSH-PULL PASSAGE LOCK MOUNTING DEVICE ADAPTED TO DOORS IN VARIOUS SIZES, which are incorporated by reference herein in their entireties.

The lever 2 rotates to drive the rotation portion 31 of the rotating block 3 to rotate, then the touch portion 32 is driven to rotate, which further drives the slipping block 4 to move, and thereby the latch bolt 5 is retracted.

After the push-pull passage lock of the present invention is installed in a door hinged to open outwardly, the inside handle 1 can be pulled or the outside handle 1 can be pushed for closing the door, and the inside handle can be pushed or the outside handle pulled to open the door. For a door hinged to open inwardly, the handle actions are reversed. The pulled or pushed handle 1 will drive the lever 2 to which drives the rotating block 3 to rotate, and thus drives the slipping block 4 to slide upwardly, whereby the latch bolt 5 is driven to retract into the door. Then, when the handle 1 is released, the lock or plunger 5 will move outward from the door and enter the recess in the door frame under the action of the compressed spring 6, thus the door is locked or retained in the closed position.

The push-pull passage lock applies fewer parts and has a simple structure.

It should be appreciated that the embodiment described hereinbefore is merely preferred embodiment of the present invention and not for purposes of any restrictions or limitations on the invention. Therefore, any simple amendments, equivalent variants and modifications to above embodiments according to the technical essence of the present invention, without departing from the technical solution of the present invention, should be incorporated into ambit of claims of the present invention.

What is claimed is:

1. A push-pull door handle assembly, comprising:

a housing adapted to extend horizontally through a door and having opposite ends extending beyond the door on opposite sides of the door, and the housing having a longitudinal axis;

a pair of levers pivotally mounted in the housing and extending in opposite direction, and each lever having an inner end and an outer end;

a pair of rotatable blocks pivotally mounted in the housing, adjacent the inner ends of the levers for engagement by the levers, and each rotatable block having a pivot axis;

a slipping block slidably mounted in the housing between the rotatably blocks and between the inner ends of the levers;

a plunger connected to the slipping block, and being extendable from the door and retractable into the door; and interior and exterior door handles connected to the outer ends of the levers;

whereby pushing and pulling the handles pivots the levers so as to rotate the rotatable blocks, thereby sliding the slipping block, whereby the plunger is retracted to allow the door to be opened; and the pivot axes of the rotatable blocks being on opposite sides of the longitudinal axis of the housing.

2. The push-pull door handle assembly of claim 1 further comprising a reset spring mounted in the housing on one end of the slipping block to urge the slipping block to a neutral position after pushing or pulling of the door handles is released.

3. The push-pull door handle assembly of claim 1 wherein each rotatable block has a pivot axis and each lever has a pivot axis, and the pivot axes of the rotatable blocks are perpendicular to the pivot axes of the levers.

4. The push-pull door handle assembly of claim 3 wherein the housing has opposite halves with mating surfaces.

5. The push-pull door handle assembly of claim 4 wherein the rotatable blocks have pivot axes which are parallel to the mating surfaces of the rotatable block halves.

6. The push-pull door handle assembly of claim 4 wherein the housing has opposite ends and further comprising a cylindrical connection fitting over the halves at each end.

7. The push-pull door handle assembly of claim 1 wherein the housing has a longitudinal cavity for receipt of the levers and a radial cavity for receipt of the rotatable blocks and the slipping block.

8. The push-pull door handle assembly of claim 7 wherein the longitudinal cavity extends on opposite sides of the radial cavity.

9. The push-pull door handle assembly of claim 1 wherein the housing has a central protuberance within which the rotatable blocks and slipping block are mounted.

10. The push-pull handle assembly of claim 1 wherein the levers pivot about vertical axes.

11. The push-pull handle assembly of claim 1 wherein the rotating blocks pivot about horizontal axes.

12. A push-pull lock for a door, comprising:

a housing mountable in the door and having opposite interior and exterior ends;

a pair of levers pivotally mounted in the housing and extending horizontally in opposite directions;

a pair of rotating blocks pivotally mounted in the housing at a midpoint between the interior and exterior ends for pivotal movement by each of the levers;

a slippage block in the housing and being movable from a neutral position to an actuated position by pivotal movement of either of the rotating blocks; and a plunger extending from the housing and connected to the slippage block for retraction when the slippage block is moved to the actuated position.

13. The push-pull lock of claim 12 wherein the levers each have a pivot axis and the rotating blocks each have a pivot axis, and the lever pivot axes being perpendicular to the rotating block pivot axes.

14. The push-pull lock of claim 12 wherein the housing has longitudinal axis between the interior and exterior ends and the rotating block pivot axes are parallel to the longitudinal axis and the lever pivot axis are perpendicular to the longitudinal axis.

15. The push-pull lock of claim 12 wherein the housing has a longitudinal axis and the slippage block moves linearly and perpendicular to the housing longitudinal axis.

16. The push-pull lock of claim 12 further comprising a spring to bias the slippage block to the neutral position.

17. The push-pull lock of claim 12 further comprising a spring for each lever to bias the lever to a neutral position.

18. The push-pull lock of claim 12 wherein each lever is adapted to be connected to a handle for pivotal movement when the handle is pushed and pulled.

19. The push-pull lock of claim 12 wherein each lever is adapted to be connected to a handle for pivotal movement the handle is pushed and pulled.

20. The push-pull lock of claim 12 wherein the housing has a first cavity for receipt of the levers and a second cavity for receipt of the rotating blocks and the slippage block.

21. The push-pull lock of claim 20 wherein the first cavity resides on opposite longitudinal sides of the second cavity.

22. The push-pull lock of claim 12 wherein the levers each have a vertical pivot axis.

23. The push-pull lock of claim 12 wherein the rotating blocks each has a horizontal pivot axis.

24. The push-pull handle assembly of claim 12 wherein the housing extends horizontally through the door and beyond opposite inside and outside planes of the door.

* * * * *